US005328059A

United States Patent [19]

Campbell

[11] Patent Number: 5,328,059

[45] Date of Patent: Jul. 12, 1994

[54] SEALED BOTTLE WATER SYSTEM

[76] Inventor: Gary J. Campbell, 6480 10th Ave., Blanchard, Mich. 49310

[21] Appl. No.: 906,398

[22] Filed: Jul. 1, 1992

[51] Int. Cl.[5] ..... B67D 5/58

[52] U.S. Cl. ..... 222/189; 141/346

[58] Field of Search ..... 222/146.6, 188, 189; 141/349, 346; 55/385.1

[56] References Cited

U.S. PATENT DOCUMENTS

| | | | |
|---|---|---|---|
| 778,012 | 12/1904 | Conover . | |
| 1,078,214 | 11/1913 | Patnaude . | |
| 1,692,066 | 11/1928 | Washburne . | |
| 3,974,863 | 8/1976 | Frahm et al. | 141/18 |
| 4,481,971 | 11/1984 | Farrell et al. | 137/315 |
| 4,629,096 | 12/1986 | Schroer et al. | 222/146.6 |
| 4,699,188 | 10/1987 | Baker et al. | 141/18 |
| 4,834,267 | 5/1989 | Schroer et al. | 222/185 |
| 4,902,320 | 2/1990 | Schroer et al. | 55/385.1 |
| 4,991,635 | 2/1991 | Ulm | 141/346 |
| 5,082,150 | 1/1992 | Steiner et al. . | |

*Primary Examiner*—Jesus D. Sotelo

*Attorney, Agent, or Firm*—Price, Heneveld, Cooper, DeWitt & Litton

[57] ABSTRACT

A sealed bottled water dispenser for using an inverted water supply bottle which has a sealing cap which, when pierced, causes water to flow into a sealed water conduit. A source of filtered air is connected to said water conduit to supply cleaned air to said water supply bottle. A check valve is placed in the water conduit to prevent unfiltered air from entering the water supply bottle through the water conduit. A check valve can be used in the water conduit to prevent water from reaching the air filter after the water supply bottle is delivering water. The latter check valve also prevents water from exiting the water bottle through the air filter, if an air leak is present in the water supply bottle. A cover is provided for sealing the water dispenser when a water bottle is not in place. The insertion of an inverted water bottle into the dispenser causes said cover to open to allow water to flow directly from the water supply bottle into the water conduit without flowing into a reservoir. A valve controls the delivery of water from the dispenser and seals the water in the dispenser from contamination.

31 Claims, 3 Drawing Sheets

SEALED BOTTLE WATER SYSTEM

CROSS-REFERENCE TO RELATED APPLICATION

The present application is related to U.S. patent application Ser. No. 07/816,213, filed Jan. 3, 1992, now U.S. Pat. No. 5,213,597 entitled FILTRATION SYSTEM FOR BOTTLED WATER DISPENSER. The inventor of that application, Gary J. Campbell, is also the inventor of this application. The content of the above-identified application is incorporated herein, in its entirety, by reference.

BACKGROUND OF THE INVENTION

Bottled water dispensers are frequently used in manufacturing plants and chemical factories to provide a supply of water convenient to the area where the employees are working. In many work areas, the air is contaminated with dust from the materials being worked upon. In chemical plants, the air is often contaminated by solvents and dust from solid materials being used in chemical processes and from finished product. The bottled water dispenser stands surrounded by this environment. When an employee takes a drink from the bottled water dispenser, the water pours from a reservoir into the cup or container held in the hand of the employee. As we are all familiar, air must enter the water supply bottle to relieve the partial vacuum in order for the water to empty from the bottle. The air frequently bubbles in an erupting stream of large and small bubbles which carry with them all of the contaminants in the ambient air surrounding a water cooler. As successive employees draw water from the dispenser, the air continues to bubble into the supply bottle, further contaminating the water as well as the water in the reservoir in the water dispenser. In order to avoid this health hazard, it would be desirable if the water in the water supply bottle could be protected from contamination as it empties and is displaced by the necessary air. Also, it would be convenient if this could be done using conventional water bottles which are not modified in any way.

Also, conventional water dispensers include a reservoir of water for sealing the bottle and for limiting air flow into the bottle. When the water drops below the end of the neck of the inverted water bottle, air can enter the bottle to relieve the partial vacuum and allow water to exit the bottle, and rise again in the reservoir, to again close off the air passage. This reservoir can also trap ambient contaminants presenting a serious health hazard.

SUMMARY OF THE INVENTION

In accordance with the present invention, a water dispenser is provided which is effectively sealed from ambient pollutants and contaminants. The dispenser does not use a reservoir to seal the inverted water supply bottle. Air is allowed to directly enter the water bottle through an air filter. The water exits the water supply bottle directly into a closed water conduit equipped with a dispensing valve from which the water is dispensed. A check valve is provided to prevent air from entering the water supply bottle through the dispensing valve. Also, a check valve can be used to stop water from reaching the air filter and to stop the flow of water through the air filter if the bottle is cracked or has a pin hole leak that will allow air to enter the inverted water supply bottle.

DETAILED DESCRIPTION OF THE PREFERRED EMBODIMENTS

Figure 1:
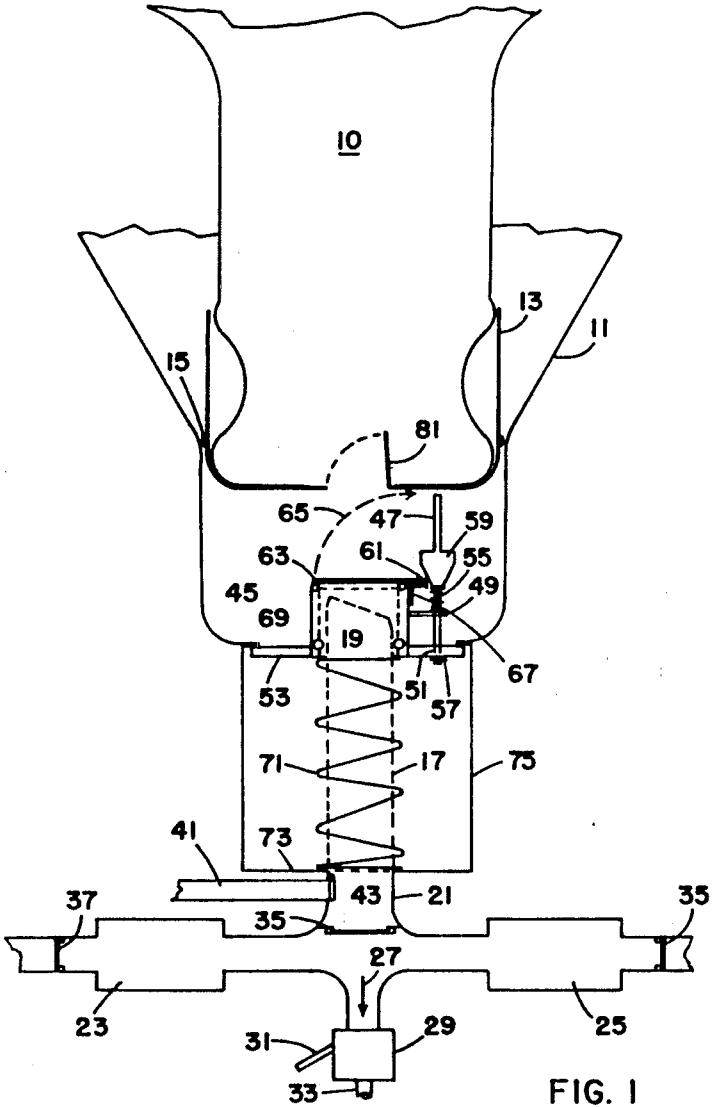
FIG. 1 is a schematic view of a covered water dispensing probe and mechanism for uncovering the probe on insertion of an inverted water bottle into the dispenser.

Referring to FIG. 1, the neck of an inverted water bottle 10 is shown being lowered into a bottle guide 11 which is located in the top of the water dispenser. The water bottle usually contains approximately five gallons of water and is made of plastic or glass. An elongated plastic cap 13 covers the open mouth of the water bottle and also has a ridge or bead 15 along the side of the cap which forms a seal with the interior of bottle guide 11. Cap 13 is conventional on water bottles and is usually torn off before the water bottle is inverted and placed into the water dispenser. The opening of the water bottle, however, exposes the fresh water inside the bottle to ambient contaminants, even if only for a short time. It is preferred to leave the bottle closed at all times and to open the bottle in the water dispenser. U.S. Pat. No. 4,699,188 discloses a cap for a water bottle which has an inwardly turned, recessed portion, extending backwardly into the neck of the bottle, which is closed by a displaceable cap. The device disclosed in this application will function with the aforementioned cap and will also function with a conventional plastic cap.

The water dispensing valve, as shown in FIG. 1, has a hollow tubular probe 17 which has a sharpened slanted edge portion 19 similar to the shape of a syringe needle; however, it does not have to be as sharp. The tubular probe is attached to a water dispensing conduit 21 through which the water can flow, for example, to the left to a water heater 23, to the right to a cooling unit 25, or directly out of the system, as indicated by the arrow 27 to a water dispensing valve 29 which has an actuating handle 31 and a spigot 33.

In order to protect the water in the water supply bottle from contaminants entering through the dispensing valves, one or more check valves can be used. A single check valve 35 can be placed near the entrance to the dispensing system to block air from coming in through the several valves into the system. Additional check valves 37 and 39 can also be provided in the hot and cold dispensing systems to prevent air from being drawn backward into the water supply bottle. Air should only enter the water supply bottle from a filtered air source 41 which supplies air to the water dispensing conduit above check valve 35.

A check valve 43 is provided at the end of filtered air conduit 41 in order to limit water from flowing through tube 41 to the air filter. Check valve 43 also serves an important function in that it prevents the contents of water bottle 10 from completely draining out through the air filter in the event there is an air leak in the bottom of the water bottle which would relieve the normal partial vacuum which is created at the bottom of the inverted bottle. Check valve 43 is preferably made from a thin flat piece of plastic, metal foil or metalized plastic film. The film which forms check valve 43 should have an elastic memory so that it will return to the normally closed position after air has ceased flowing through filtered air supply conduit 41. The previously mentioned check valves 35, 37 and 39 can be conventional plastic or metal check valves. These check valves are well known in the art and are commercially available items.

Bottle guide 11 helps to center water bottle 10 above probe 17 as it is being lowered into the bottle guide. The bottle guide is configured to support the shoulders of the water bottle (not shown) which is common in the art and also to provide an abutting annular surface 45 against which the cap of the water bottle can rest.

As water bottle 10 is lowered into bottle guide 11, the face of cap 13 will contact an activating rod 47. Activating rod 47 is guided through an aperture in a flange 49 and through an aperture 51 in a platform 53. A coil spring 55 rests on the top of flange 49 and urges pin 47 upwardly. A pin 57 retains actuating rod 47 in place and prevents it from being drawn upwardly through aperture 51 in platform 53.

Actuating rod 47 has an inverted, circular, conical camming member 59 which, on being pushed downwardly by the bottle cap, contacts a camming surface 61 on cover 63, causing the cover to pivot upwardly, as shown by the dashed arrow 65. A hinge 67 pivotally fastens cover 63 on the top of an upstanding tubular member 69, which is supported on platform 53 and surrounds the sloped sharpened end of probe 17. A bias spring 71 surrounds probe 17 and rests upon the bottom 73 of a protective cup-like shield 75 which surrounds the spring and a portion of tubular probe 17.

When the water bottle is inserted, the cap of the water bottle strikes the actuating rod 47 pushing camming surface 59 downwardly against cam surface 61 on cap 63 causing the cover to open. The continued downward motion of the water bottle forces platform 53 and supported tube 69 downwardly until the bottle comes to rest against annular stop 45. Before the bottle reaches stop 45, the sharpened end 19 of probe 17 will cut a flap 81 in cap 13 on the water bottle. In FIG. 1, flap 81 is shown cut before the water bottle reaches probe 17, for clarity. The bottle would normally be closed until probe 17 pierces the cap cutting flap 81. Since probe 19 is sharpened, the edge of the probe is relieved or angled inwardly which causes the probe to cut a hole in cap 13 slightly smaller than the outer diameter of probe 17. This smaller hole in the cap tightly grips the outer surface of probe 17 precluding any air or water leakage.

With the water bottle in place, dispensing valve 29 can be actuated to draw water from the bottle. The water will push open check valve 35 and flow outwardly through spigot 33. Any air needed to relieve the partial vacuum in the bottom of water bottle 10 will flow inwardly through tube 41 and check valve 43 and bubble upwardly through the water to the inverted bottom of the bottle. It can be seen that the system is completely sealed with the exception of the filtered air source. The filter used with the air source can be a single or compound filter designed to protect the water from the specific contaminants in the air surrounding the water dispenser. If biological materials are present, a microfilter can be used. If organic solvents are present, an activated charcoal filter can be used and if dust is present, a coarse paper or filberglass filter can be used. For mixed contaminants, the filter can be assembled with layers of different filter materials to protect the water.

It should be noted in FIG. 1 that tubular member 69 and cover 63 protect the interior of tubular probe 17 and the interior of the water delivery system from contaminants during the short time that a bottle is not in place in bottle guide 11. The interior of probe 17 and attached water conduit 21 is only opened when a water bottle 10 forces actuating rod 47 downwardly, opening cover 63.

Turning now to FIG. 2, bottle guide 11 is again provided for centering water bottle 10 and for supporting the inverted water bottle. A probe 91 is centrally positioned within bottle guide 11. Probe 91 has a closed end portion 93 which has a plurality of circumferentially spaced apertures 95 through which water can enter the interior of probe 91. Probe 91 is particularly intended for use with the bottle cap disclosed in previously mentioned U.S. Pat. No. 4,699,188. An actuating rod 97 is supported in a pair of spaced flanges 99 and 101 which are attached to the side of a tubular member 103. A pin 105 prevents actuating rod 97 from being pulled upwardly through flange 101 under the influence of spring 107 which surrounds actuating rod 97 and rests on the top surface of upper flange 99. When a water bottle enters bottle guide 11 and descends, as shown by arrow 109, it applies pressure to the end of actuating rod 97, causing it to be pushed downwardly. A link 111 is pivotally attached to actuating rod 97 and to the edge of cover 113 which is pivotally attached by hinge 115 at the upper edge of tubular member 103. Cover 113 and tubular member 103 effectively cover the end of probe 91. If necessary, an annular seal 117 can be positioned about the top of tubular member 103 to assist in sealing the water system. Also, 0-rings 119 and 121 can be positioned above and below circumferential apertures 95 to provide an improved seal.

As the water bottle enters bottle guide 11, it forces actuating rod 97 downwardly which, as previously described, causes cover 113 to open. The water bottle continues downwardly until probe 91 displaces the cap from the interior of the water bottle and the bottle comes to rest on the shoulders of bottle guide 11. A guide rod 123 is provided for controlling the motion of tubular member 103 as it is pushed downwardly. A coil spring 125 is positioned about probe 91 and urges the cover assembly upwardly. A flange 127 is attached to the side of tubular member 103 and has an aperture 129 therein for guiding flange 127 upon rod 123. A pin 131 projects through the end of rod 123 and prevents the cover assembly from being pushed beyond the end of probe 91.

Figure 2:
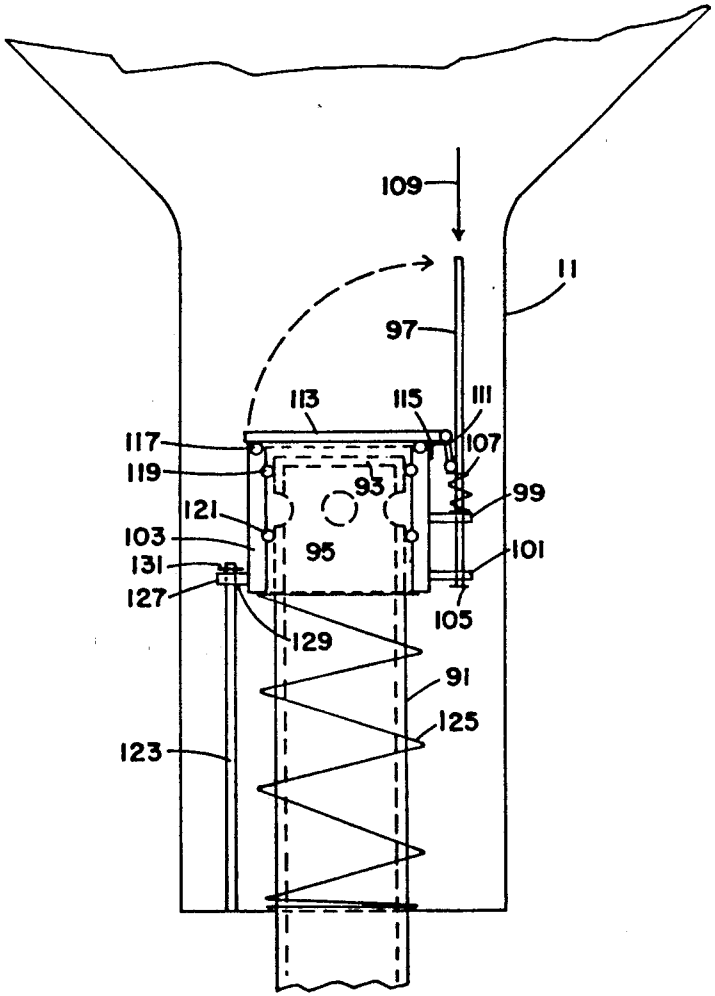
FIG. 2 is a second embodiment of a covered water dispensing probe and uncovering mechanism.

Similar check valves and dispensing conduits can be attached to probe 91, as well as a filtered air source 41, to provide an enclosed and sealed water system. The cover of FIG. 2 is similar to the cover of FIG. 1 in that it protects the end of the probe from access to ambient contaminants when a water bottle is not in position.

Figure 3:
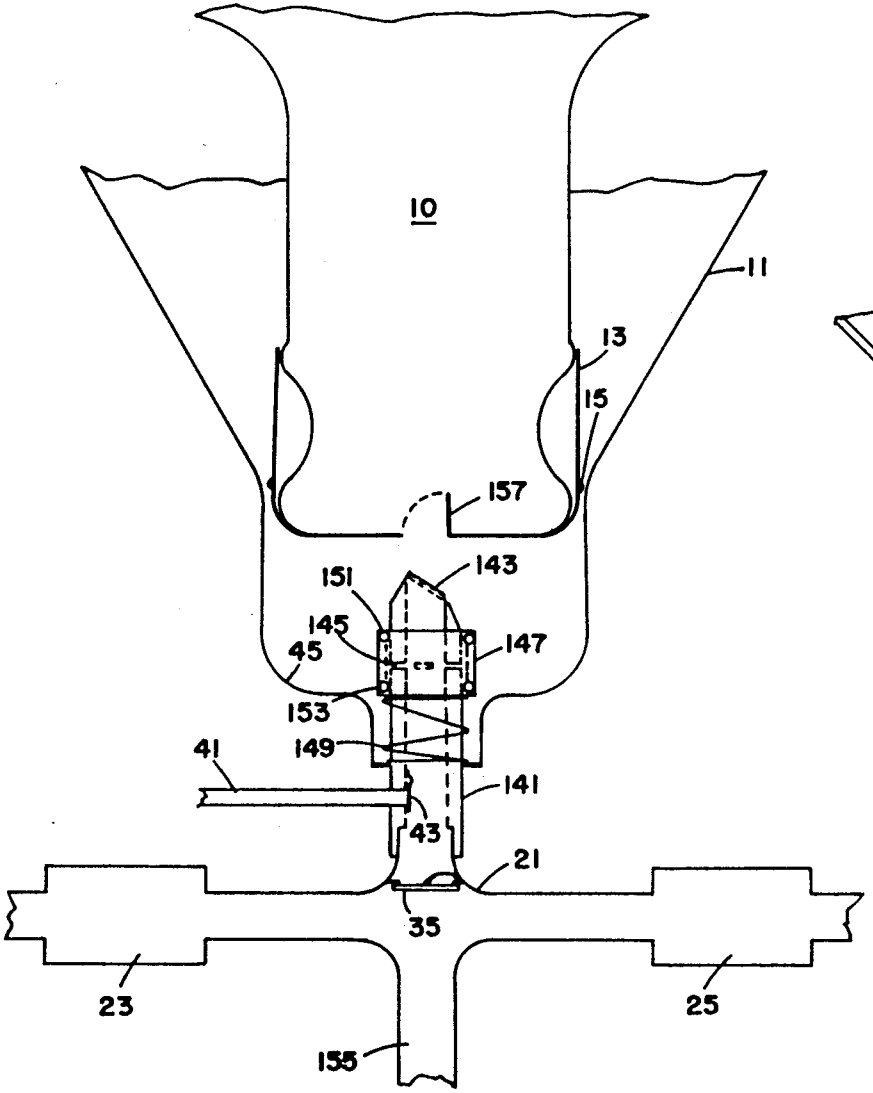
FIG. 3 is an uncovered but sealed water dispensing probe.

In FIG. 3, a dispensing system is shown in which the end of the probe is not protected from ambient contaminants while the interior of the probe and the water conduit delivery system is sealed. A bottle guide 11 is again provided for centering an inverted water supply bottle 10 as it is inserted into the water dispenser. A plastic cap 13 closes the end or mouth of the water bottle. Cap 13 has a raised bead 15 for forming a seal against the interior of bottle guide 11. In this figure, as in FIG. 1, the cap of the water bottle is shown as cut while the bottle is separated from the probe. This has been done to facilitate the explanation of the invention. It is obvious that the cutting takes place after the cap is contacted and penetrated by the probe.

A tubular probe 141 has an exposed pointed end portion 143 for penetrating cap 13 on the water bottle. Probe 141 has a row of circumferential apertures 145 for providing access to the interior of the probe. Apertures 145 are closed by a slidable collar 147 which is positioned and supported on the outer surface of probe 141. A spring 149 biases collar 147 upwardly to cover apertures 145. Spaced O-rings 151 and 153 are provided for tightly sealing cover 147 above and below apertures 145 in order to seal the interior of tubular probe 141 and the interior of water delivery conduit 21 from airborne contaminants. Water delivery conduit 21 is similar to that shown in FIG. 1, which has a heater 23 and a water cooler 25 connected to a common conduit which also has access through a valve (not shown) for direct delivery of water through conduit portion 155. A check valve 35 is again used to block access to the interior of water supply bottle 10 from air being drawn in through any of the delivery valves attached to water conduit 21. A filtered air source 41, having a check valve 43, as previously described, provides filtered air to the interior of the water supply bottle.

When water supply bottle 10 is lowered into bottle guide 11 (FIG. 3) end 143 of probe 141 cuts a flap 157 in the end of plastic cap 13. The bottle and punctured cap can now slide downwardly on the outer surface of probe 141, pushing collar 147 downwardly against the upward pressure of spring 149 until the bottle comes to rest on annular stop 45. Water can now freely flow from the bottle into apertures 145 into probe 141 and into the water system. Any air needed to relieve the partial vacuum created in the bottom of the inverted water bottle is supplied through air source 41.

As previously mentioned, check valves 35 and those shown in FIG. 1 prevent air from entering into the water supply bottle through the water delivery conduit. This is also important in the event the filtered air source 41 becomes blocked for any reason, for example, if the filter is not changed or a cover is not removed from the filter. If this were to occur, no air could enter the water bottle through the filtered air source 41 and air would attempt to enter the water supply bottle through the delivery valves. Check valve 35, and the other check valves previously mentioned, block this air from entering, effectively disabling the water dispenser and signaling the person wishing to take a drink that the air filter needs to be opened or replaced in filtered air source 41.

Figure 4:
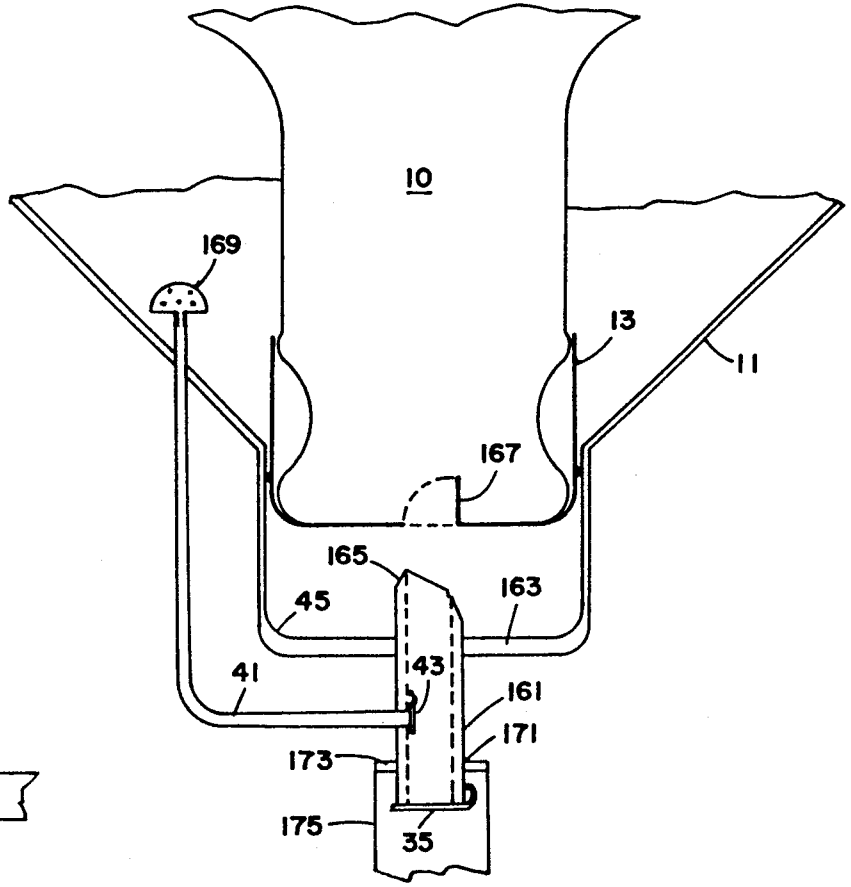
FIG. 4 is an open water dispensing probe.

In FIG. 4, a substantially simplified water dispensing system is shown having a probe 161 attached to a bottom portion 163 of bottle guide 11. Probe 161 has a sharpened sloping end 165 which can penetrate cap 13 cutting a flap 167 which is turned upwardly and pushed backwardly. Air supply 41 is connected to the side of probe 161. Flap check valve 43, as previously described, is placed over the end of filtered air source 41. A schematically illustrated air filter 169 is on the end of filtered air source 41. Probe 161 can be mounted in an aperture 171 in an annular seal 173 closing one end of water delivery conduit 175. A check valve 35 is again provided for blocking the entry of air into water supply bottle 10, particularly in the event filtered air source 41 is obstructed for any reason. Probe 161 is not covered or sealed in the embodiment shown in FIG. 4.

Figure 5:
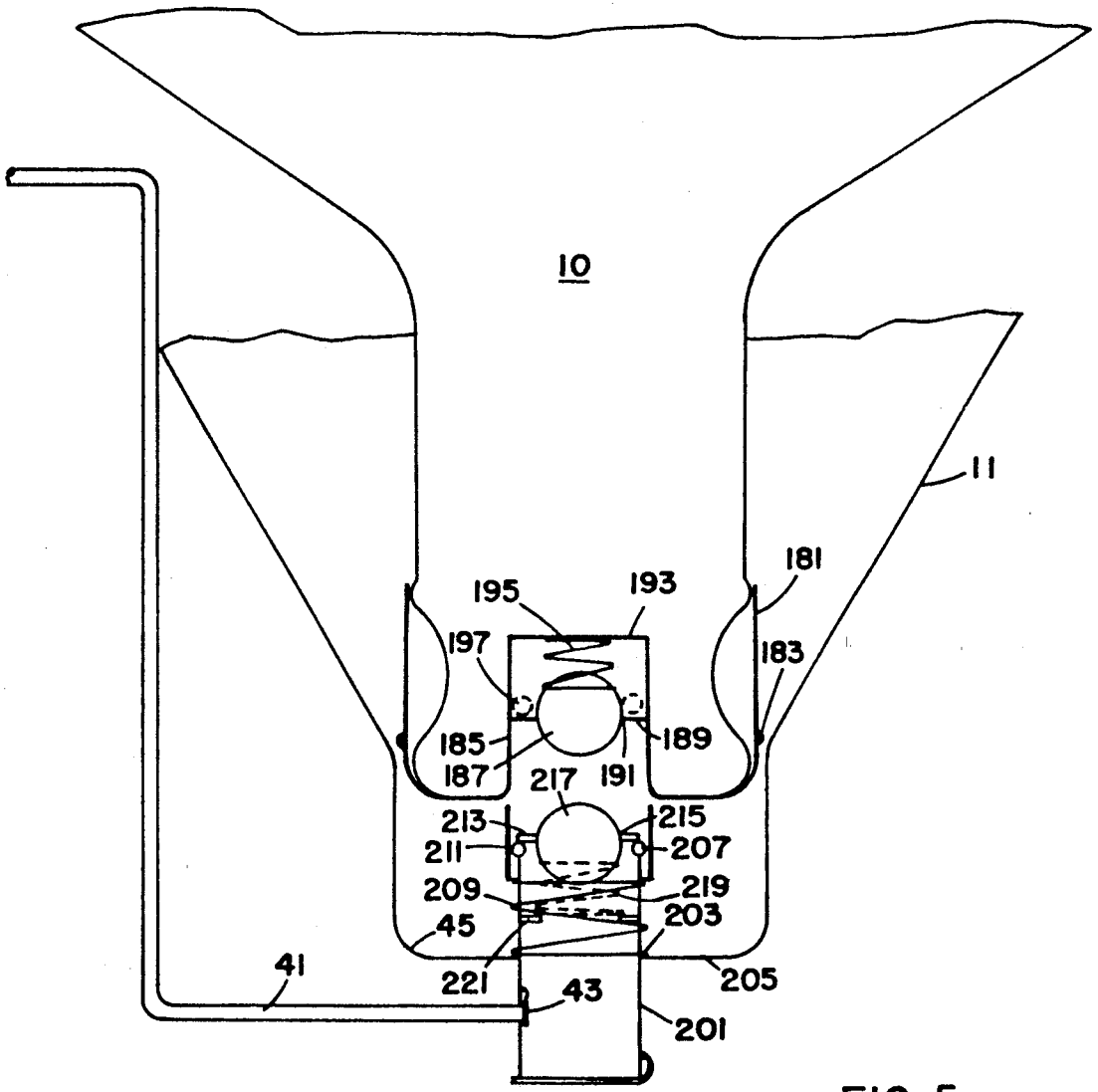
FIG. 5 is a schematic illustration of a closed water bottle and closed water dispensing probe which are automatically opened when joined.

An improved bottle cap and probe combination is shown in FIG. 5. A plastic bottle cap 181 is used to cover the mouth and a portion of the neck of water supply bottle 10. Cap 181 has a raised portion or bead 183 for forming a seal about the interior of bottle guide 11. Cap 181 also has an inwardly turned, tubular portion 185 which extends into the water bottle beyond the mouth of the bottle. Within this tubular portion, a sealing member 187 is mounted in an apertured plate 189 which has an orifice 191 or valve seat centrally located in plate 189. Tubular portion 185 has a closed end 193. Spring 195 rests against closed end 193 and urges sealing member 187 into valve seat 191 to seal the water bottle. A plurality of apertures 197 are provided about tubular portion 185. Water can flow from water bottle 10 and through apertures 197 and past valve seat 191 when valve member 187 is pushed backward. Valve member 187 is indicated as being a ball, which is the preferred valve member, in view of its low cost and ready availability. Obviously other shapes, for example a conical valve member, can also be used and is within the scope of the present invention.

A tubular member 201 is sealed into an aperture 203 in the bottom 205 of bottle guide 11. An outer collar 207 surrounds the upward end, as shown in FIG. 5, of tube 201 and is spring biased in that position by a coil spring 209 about the outer surface of tubular member 201. An O-ring 211 is positioned adjacent the end of tubular member 201. Collar 207 functions as a drip collar to collect any water which might spill from the water supply bottle as valve seat 191 is being opened or closed. A sealing plate 213 closes off the end of tubular member 201. An aperture 215 is provided in sealing plate 213 and functions as a valve seat for valve member 217 which is urged upwardly into the valve seat by a coil spring 219 which is interior to tubular member 201 and supported on an annular shoulder 221.

When a bottle using cap 181 of FIG. 5 is to be drained, a sealing member (not shown) can be pulled off the end of the collar exposing valve member 187. The bottle can then be inverted and lowered into bottle guide 11 which centers the neck of bottle 10 above tubular member 201. As the bottle descends, valve member 187 in cap 181 and valve member 217 in tubular member 201 are pushed backwardly, opening the fluid passage from the interior of water bottle 10 around the valve members and into tubular member 201 where the water can be distributed in the water dispensing system, as shown in FIGS. 4 and 1. Filtered air is again supplied from a source 41 into the side of tubular member 201. A flap check valve 43 is again used to close the source of filtered air. When water bottle 10 is emptied, it can be raised upwardly out of bottle guide 11 which causes valve member 187 in cap 191 to close the water bottle, protecting the inside from contamination while valve member 217 closes the water dispensing system.

From the above description, it can be seen that a sealed water dispensing system is provided which no longer uses the conventional reservoir for containing water. The water is delivered directly from the water supply bottle to a water dispensing conduit or plumbing inside the water dispenser with the air needed to displace the partial vacuum in the bottom of the water supply bottle being supplied from a filtered source. By using the system of the present invention, the water is substantially protected from all airborne contaminants.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A sealed bottled water dispenser comprising:

a bottle guide for receiving the closed neck of an inverted water supply bottle;

a tubular probe positioned at the bottom of said bottle guide for penetrating a cap on a water bottle and for conveying water from said bottle;

a delivery conduit, said delivery conduit having a first end connected to said tubular probe and a second end for delivering water from said water bottle;

at least one dispensing valve for controlling the flow of water from said delivery conduit;

a first check valve for said delivery conduit, said first check valve allowing water to drain from a water supply bottle while preventing air from entering a water supply bottle through said dispensing valve; and an air filter means connected to said delivery conduit for supplying filtered air to a water supply bottle as water leaves a supply bottle.

2. A sealed bottled water dispenser as set forth in claim 1, including a second check valve for said filter means for allowing air to pass through said second check valve into a water supply bottle while said second check valve limits flow into said air filter means.

3. A sealed bottled water dispenser as set forth in claim 1, wherein said tubular probe has a sloped leading edge for perforating a cap on a water supply bottle.

4. A sealed bottled water dispenser as set forth in claim 1, wherein said bottle guide has a tubular depending portion configured to receive and form a seal with a cap on a water supply bottle.

5. A sealed bottled water dispenser as set forth in claim 4, wherein said tubular depending portion is configured to form a seal with the side of a cap on a water supply bottle.

6. A closed bottle water dispensing system as set forth in claim 4, wherein:

said tubular probe has a closed end and at least one aperture on the side of said tubular probe;

a slidable collar for reversibly covering said at least one aperture in the side of said probe, said collar being pushed downwardly by the cap on a bottle of water, opening said at least one aperture; and a biasing means for restoring said collar to the position wherein said at least one aperture is closed when said water supply bottle is removed from said tubular probe.

7. A closed bottle water dispensing system comprising:

a bottle guide for receiving the neck portion of a water supply bottle having a sealed cap;

a tubular probe near the bottom of said bottle guide for puncturing a sealed cap on a water supply bottle;

a dispensing conduit for receiving water from said tubular probe;

a source of filtered air connected to said dispensing conduit for supplying filtered air to a water supply bottle opened by said tubular probe;

a dispensing valve for sealing said water system and for controllably delivering water from said water conduit; and a check valve for said dispensing conduit for preventing air from entering a water supply bottle through said dispensing valve.

8. A sealed bottled water system comprising:

bottle guide means for receiving the neck portion of a sealed water bottle;

a tubular probe below and in line with the sealed water bottle for piercing the seal on the water bottle and for allowing water to drain from the bottle through said tubular probe;

a cover means for said tubular probe for protecting the probe and water system from contamination when a water bottle is not in place;

means for opening said cover means as a sealed water bottle descends;

conduit means for receiving the water flowing through said tubular probe;

closure means for sealing said conduit means and for controllably releasing water therefrom;

check valve means for preventing air from entering a water supply bottle through said closure means; and filtered air means for supplying filtered air to said conduit means and to said bottle of water to enable water to freely flow from said water supply bottle.

9. A sealed bottled water system as set forth in claim 8, wherein said bottle guide means is substantially funnel-shaped and has a depending tubular portion configured to form a watertight seal about the sides of a cover on a sealed water supply bottle.

10. A sealed bottled water system as set forth in claim 9, wherein said depending portion of said bottle guide means has an inwardly directed annular shelf means for contacting a bottle cover on a sealed water bottle.

11. A sealed bottled water system as set forth in claim 8, wherein said cover means for said tubular probe includes:

a movable platform having an aperture therein for receiving said tubular probe;

a tubular means extending upwardly from said platform for enclosing a portion of said tubular probe;

a tube cover for closing said tubular means;

a hinge means for pivotally supporting said tube cover on the distal end of said tubular means;

a cam follower means carried on said cover adjacent said hinge means;

a cam means for moving said cam follower means on said tube cover for opening said tube cover, said cam means and said movable platform being pushed downwardly by a sealed water bottle exposing said tubular probe; and a biasing mean for urging said platform upwardly.

12. A sealed bottled water system as set forth in claim 11, wherein said bottle guide means has a depending tubular portion, and further including:

an annular surface on said depending tubular portion of said bottle guide means for contacting the sealed bottle cover of a water supply bottle and for stopping the upward movement of said platform under the influence of said biasing means.

13. A sealed bottled water system as set forth in claim 8, wherein said filtered air means includes:

a tubular means attached to a sidewall of said conduit means; and an air filter means connected to the free end of said tubular means for allowing filtered air to flow to a water supply bottle.

14. A sealed bottled water system as set forth in claim 13, further including a check valve for said filtered air means, said check valve enabling air to flow through said tubular means into said conduit means while limiting water from entering said air filter means.

15. A sealed bottled water system as set forth in claim 14, wherein said check valve is flexible metal foil attached along an edge and depending over an aperture in said sidewall of said conduit means where said tubular means attaches to said conduit means.

16. A sealed bottled water system as set forth in claim 14, wherein said check valve is a flexible film of plastic material.

17. A sealed bottled water system as set forth in claim 14, wherein said check valve is a flexible film of metalized plastic film.

18. A sealed bottled water system as set forth in claim 8, wherein said cover means for said tubular probe comprises:

a slidable tubular member for covering a portion of an upstanding end of said tubular probe;

a cover member pivotally attached to said tubular member;

a link member having a first and a second end, said first end being pivotally attached to said cover member;

a movable actuating member slidably attached to said tubular member and extending upwardly beyond said cover member, said actuating member being attached to said second end of said link member; and a biasing means for supporting said tubular member adjacent the end portion of said tubular probe, whereby the sealed end of an inverted water bottle inserted into said bottle guide means will depress said actuating member opening said cover over said tubular probe, and upon further insertion the water bottle will depress the tubular member on said tubular probe allowing said tubular probe to penetrate said sealed water bottle.

19. A sealed bottled water system as set forth in claim 18, wherein said tubular probe has a closed end and a plurality of circumferentially spaced apertures which are enclosed by said cover means.

20. A sealing cap for use on a water supply bottle for use in an inverted bottle-type dispenser comprising:

a cap for securing on the neck of a water bottle having a sleeve portion for covering a portion of the bottle neck adjacent the open end of a bottle and a closed tubular recessed portion for extending into the neck of a water bottle, said tubular recessed portion having at least one aperture therein communicating with the inside of a water bottle;

a valve in said tubular recessed portion, said valve including:

a valve seat about the interior of said tubular recessed portion;

a valve member for closing said valve; and a bias means for urging said valve member into said valve seat sealing said water bottle.

21. A sealing cap as set forth in claim 20, wherein:

said valve seat is an annular surface about the interior of said tubular recessed portion; and said valve member is a ball, a portion of which will extend through said annular valve when said valve seat is closed.

22. A sealed bottled water system comprising:

a bottle guide for receiving the neck portion of an inverted sealed water bottle, said bottle guide having a tubular depending portion configured to receive and form a seal against a cap on a water supply bottle;

an annular stop for said depending tubular portion of said bottle guide;

a tubular member extending through an aperture in said annular stop;

a valve in said tubular member, said valve including:

a valve seat in said tubular member;

a valve member in said tubular member for closing said valve and said tubular member;

a bias means in said tubular member for urging said valve member into said valve seat;

a water conduit attached to an end of said tubular member;

a dispensing valve for controlling the flow of water through said water conduit and for sealing said water system;

a check valve for/said water conduit, said check valve allowing water to drain from a water supply bottle while preventing air from entering said water supply bottle through said dispensing valve; and an air filter means connected to said water conduit for allowing filtered air to enter a water supply bottle as water leaves said supply bottle.

23. A sealed bottled water system as set forth in claim 22, wherein:

said valve seat is an annulus about the interior of said tubular member; and said valve member is a ball, a portion of which extends through said valve seat when said valve is closed.

24. A sealed water bottle for the water system of claim 22, comprising:

a water supply bottle;

a cap for securing on the neck of said water supply bottle including a closed tubular recessed portion for extending into the neck of a water bottle, said tubular recessed portion having at least one aperture therein communicating with the inside of a water bottle;

a valve in said tubular recessed portion, said valve including:

a valve seat;

a valve member for closing said valve seat; and a bias means for urging said valve member into said valve seat sealing said water bottle.

25. A liquid supply system comprising:

a container for holding a quantity of liquid:

a first check valve operatively connected to said container for enabling air to enter said container while preventing liquid from exiting the container through said first check valve; and a second check valve operatively connected to said container for enabling liquid to exit said container through said second check valve while preventing air from entering said container through said second check valve, said second check valve being operatively connected at a lower location on said container than said first check valve.

26. A liquid supply system as set forth in claim 25, including:

a conduit through which liquid exits said container, said second check valve being in said conduit.

27. A liquid supply system as set forth in claim 25, including an air filter operatively connected to said first check valve for supplying filtered air to said container through said first check valve.

28. The liquid supply system as defined in claim 26, further including a dispensing valve coupled to said conduit, said second check valve positioned between said container and said dispensing valve, such that water flows out through said second valve, said conduit, and said dispensing valve, when said dispensing valve is open and said second check valve prevents air from entering said container through said dispensing valve an said conduit downstream of said first check valve.

29. A system for delivering liquid comprising:

a container for holding a quantity of liquid;

a first check valve operatively connected to said container through which air can flow to displace liquid leaving said container and which prevents liquid from leaving said container through said first check valve;

a water liquid delivery system connected to said container; and a second check valve in said liquid delivery system which enables liquid to flow from said container through said second check valve while said second check valve prevents air from entering said container.

30. A system for delivering liquid as set forth in claim 29, wherein said second check valve is operatively connected to said container at a lower position on said container than that at which said first check valve is operatively connected to said container.

31. A system for delivering liquid as set forth in claim 29, including an air filter operatively connected to said first check valve for supplying filtered air to said container.

* * * * *